US007540363B2

(12) United States Patent
Tonelli

(10) Patent No.: US 7,540,363 B2
(45) Date of Patent: Jun. 2, 2009

(54) ASSEMBLY FOR FIXING A SHOULDER STRAP TO CONTAINERS

(75) Inventor: Massimo Tonelli, Casalecchio Di Reno (IT)

(73) Assignee: G.T. Line S.R.L., Crespellano (IT)

( * ) Notice: Subject to any disclaimer, the term of this patent is extended or adjusted under 35 U.S.C. 154(b) by 28 days.

(21) Appl. No.: 11/431,872

(22) Filed: May 11, 2006

(65) Prior Publication Data

US 2006/0278485 A1 Dec. 14, 2006

(30) Foreign Application Priority Data

May 27, 2005 (IT) ..... B02005A0373

(51) Int. Cl.
*A45C 13/26* (2006.01)
*A45C 13/30* (2006.01)

(52) U.S. Cl. ..... 190/116; 190/39; 190/115; 220/759

(58) Field of Classification Search ..... 190/39, 190/115, 116; 150/107, 110; 220/759, 760, 220/769; 16/405, 408, 425; 24/265 R; 224/610, 224/616

See application file for complete search history.

(56) References Cited

U.S. PATENT DOCUMENTS 3,180,385 A * 4/1965 Shigehaur ..... 220/760
4,119,248 A * 10/1978 Butler et al. ..... 224/148.3
4,196,821 A * 4/1980 Teti et al. ..... 220/756
4,515,419 A * 5/1985 Hampel et al. ..... 312/7.1
5,127,500 A * 7/1992 Mitchell ..... 190/115
5,186,290 A * 2/1993 Takayama ..... 190/108
5,344,041 A * 9/1994 Luburic et al. ..... 220/760
5,363,790 A * 11/1994 Matsuoka ..... 114/315
5,713,439 A * 2/1998 Zionts et al. ..... 190/102
5,911,348 A * 6/1999 Shook ..... 224/629
6,080,922 A * 6/2000 Dimbath ..... 84/327
6,164,505 A * 12/2000 Holter et al. ..... 224/259
6,779,680 B1 * 8/2004 Schwarz ..... 220/773

FOREIGN PATENT DOCUMENTS

GB 2236471 A * 4/1991
JP 4290606 A * 10/1992

* cited by examiner

*Primary Examiner*—Sue A Weaver
(74) *Attorney, Agent, or Firm*—Modiano & Associati; Albert Josif; Daniel J. O'Byrne

(57) ABSTRACT

An assembly for fixing a shoulder strap to containers, such as cases, trunks and the like, comprising, for each one of the ends of the shoulder strap, a respective receptacle, which is provided at the outer surface of the case and is adapted to accommodate at least one element for detachable retention of the end which is provided with at least one female thread, the receptacle comprising laterally at least one through hole for insertion of a respective screw, which is adapted to engage detachably in the female thread, its head being engaged in at least one eyelet provided in the end of the shoulder strap.

8 Claims, 1 Drawing Sheet

ASSEMBLY FOR FIXING A SHOULDER STRAP TO CONTAINERS

The present invention relates to an assembly for fixing a shoulder strap to containers, such as cases, trunks and the like.

BACKGROUND OF THE INVENTION

In various known types of case, bag, trunk and the like, the shoulder strap for carrying is usually rigidly coupled to the body of the bag or case by means of spring clips or other equivalent devices, which can be locked manually by snap action. Generally, the spring clips are fixed to the bags, cases and the like by means of stitches, adhesive bonding, or other low-cost techniques which allow rapid execution.

However, these fixing techniques have limited effectiveness and reliability when the bag or case being considered is intended for particular technical and professional applications rather than for simply carrying ordinary items (for example, for carrying delicate and expensive instruments); in these special applications, it must in fact be ensured that the shoulder strap does not separate accidentally from the body of the case due to breakage of the seams, separation of the parts joined by adhesive bonding, or other similar unwelcome mishaps. For this reason, the technician or professional who uses the case must also be able to check at all times the state of the reliability of the fixing in order to avoid accidental separations.

SUMMARY OF THE INVENTION

The aim of the present invention is to obviate the abovementioned drawbacks, by providing an assembly for fixing a shoulder strap to cases, trunks and the like which is adapted to provide the greatest assurances of reliability against accidental breakages.

Within this aim, an object of the present invention is to provide an assembly for fixing a shoulder strap to cases, trunks and the like which is extremely versatile in application and use.

Another object of the present invention is to provide an assembly for fixing a shoulder strap to cases, trunks and the like which allows to check, and optionally restore, at all times the full solidity and reliability of said fixing, with particular reference to critical and delicate operating conditions.

Another object of the present invention is to provide an assembly which is simple, relatively easy to provide in practice, safe in use, effective in operation, and has a relatively low cost.

This aim and these and other objects that will become better apparent hereinafter are achieved by an assembly for fixing a shoulder strap to containers, such as cases, trunks and the like, characterized in that it comprises, for each one of the ends of the shoulder strap, a respective receptacle, which is provided at the outer surface of the case and is adapted to accommodate at least one element for detachable retention of said end which is affected by at least one female thread, said receptacle being affected laterally by at least one through hole for the insertion of a respective screw, which is suitable to engage detachably in said female thread, its head being in turn engaged in at least one eyelet provided in said end of the shoulder strap.

BRIEF DESCRIPTION OF THE DRAWINGS

Further characteristics and advantages of the invention will become better apparent from the following detailed description of a preferred but not exclusive embodiment of an assembly for fixing a shoulder strap to cases, trunks and the like according to the invention, illustrated by way of non-limiting example in the accompanying drawings, wherein.

DESCRIPTION OF THE PREFERRED EMBODIMENT

Figure 1:
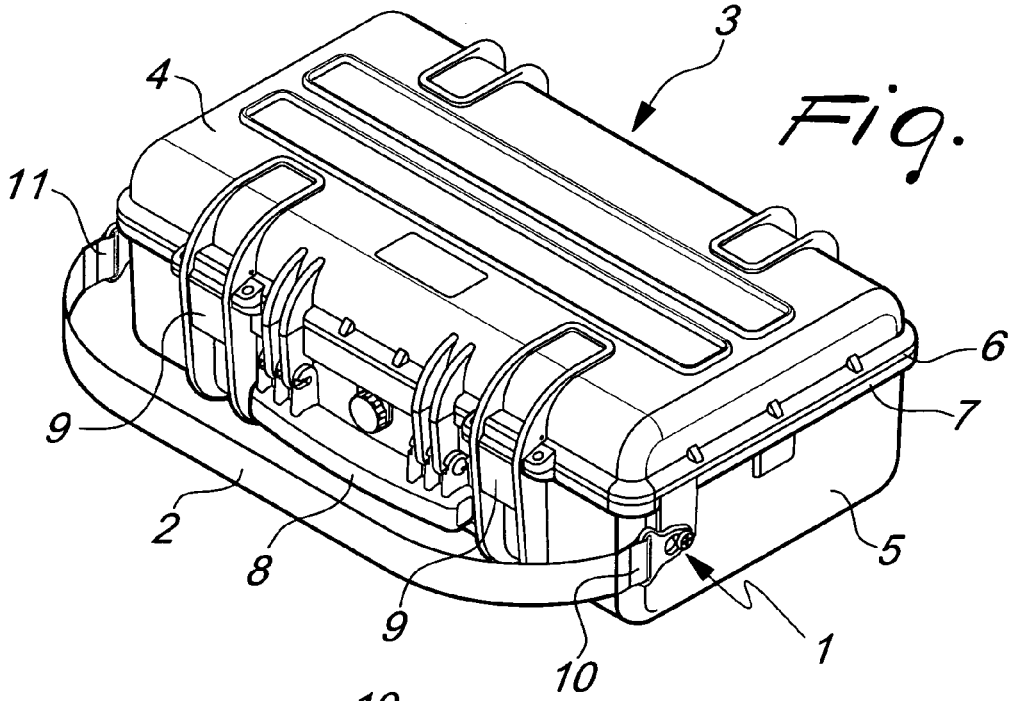
FIG. 1 is a perspective view of a case with a shoulder strap fixing assembly according to the invention.

In the exemplary embodiment that follows, individual characteristics may actually be interchanged with other different characteristics that exist in other exemplary embodiments.

Moreover, it is noted that anything found to be already known during the patenting process is understood not to be claimed and to be the subject of a disclaimer.

With reference to the figures, the reference numeral 1 generally designates an assembly for fixing a shoulder strap to containers, such as cases, trunks and the like according to the invention, which is adapted in particular, in the embodiment described hereafter, to couple a shoulder strap 2 to a case, generally designated by the reference numeral 3.

The case 3 shown in the figures is, in particular, a rigid hermetic case for technical and professional applications; however, it is noted that the fixing assembly according to the invention can be used equally to connect a shoulder strap to any case, bag, trunk or similar container.

The case 3 (FIG. 1) comprises, in a traditional manner, a first half-shell 4 and a second half-shell 5, which are mutually articulated by means of hinges and mate, in the closed configuration, respectively along a first edge 6 and a second edge 7; the case 3 further comprises a handle 8 and locks 9, which are fully conventional.

According to the invention, the assembly 1 advantageously comprises, for each of the ends 10, 11 of the shoulder strap 2, a respective receptacle 12, which is provided at the outer surface 13 of the case 3 and is adapted to accommodate at least one element 14 for detachable retention of the ends 10, 11. The retention element 14 is affected conveniently by at least one through female thread 15 (FIG. 2); further, the receptacle 12 is conveniently affected laterally by at least one through hole 16, which is suitable in particular for the insertion of a respective screw 17, which is intended to engage detachably in the female thread 15.

The screw 17 comprises a head 18, a central portion 19 and a threaded end portion 20: the head 18 is engaged advantageously in at least one eyelet 21, which is provided in each one of the ends 10, 11 of the shoulder strap 2.

Conveniently, each receptacle 12 is shaped like a pocket (FIG. 2) and is formed by a sort of protrusion 22, which is provided substantially at the second edge 7 of the second half-shell 5 of the case 3; the protrusion 22 conveniently has a transverse cross-section which is substantially shaped like an inverted letter U, and is open on the opposite side with respect to the second edge 7, in order to allow the manual insertion and extraction of the retention element 14.

Figure 2:
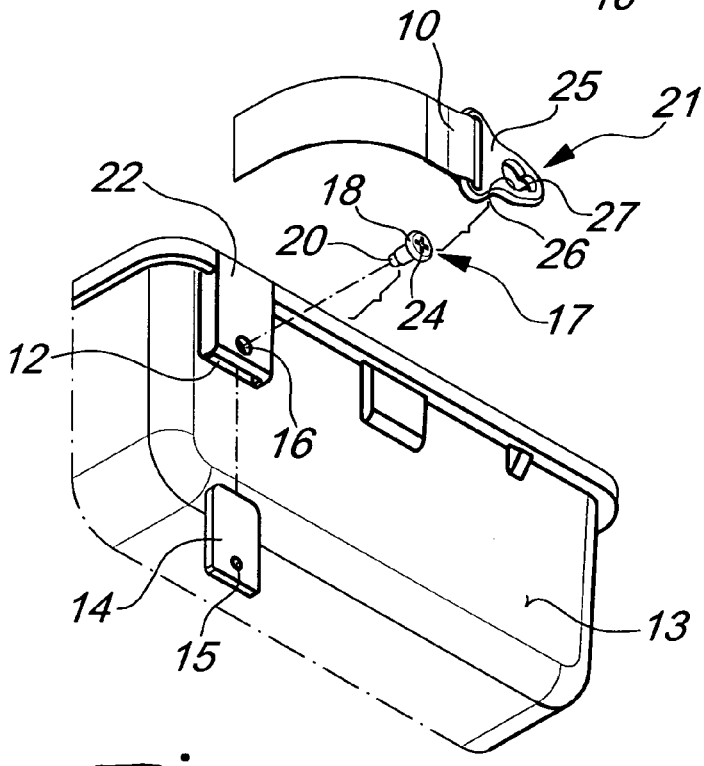
FIG. 2 is a detailed perspective view of said assembly.

In the particular embodiment described, and as shown in FIG. 2, each protrusion 22 is provided substantially monolithically, and preferably by molding, with the second half-shell 5 of the case 3.

Each one of the retention elements 14 is conveniently substantially shaped like a plate, and has a substantially rectangular transverse cross-section which is thin and complementary with respect to the cross-section of the respective receptacle 12, within which it is accommodated with an appropriate play in order to allow its easy and quick insertion and its easy and quick manual extraction.

Figure 3:
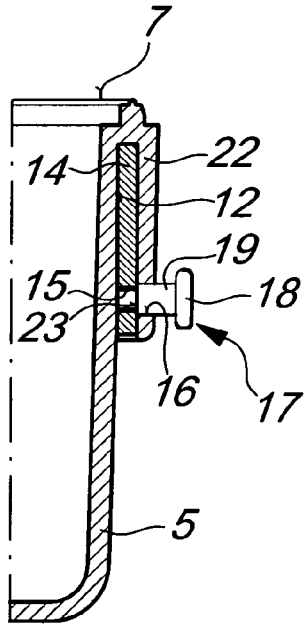
FIG. 3 is a partially sectional detailed side elevation view of the assembly according to the invention.

The threaded end portion 20 of each one of the screws 17 is adapted to engage detachably in the through female thread 15 of the retention element 14. The central portion 19 of each one of the screws 17 has a larger diameter than the threaded end portion 20 and is adapted to be inserted in the through hole 16 which affects the receptacle 12. The central portion 19 further forms a surface 23 for abutment against the retention element 14 for locking within the receptacle 12 (FIG. 3). The head 18 of each one of the screws 17 is affected by a cross-shaped notch 24 (or by a notch having another shape) for quick removal with a screwdriver.

Each eyelet 21, formed in a plate 25 associated with the respective end 10, 11 of the shoulder strap 2, has a first portion 26 for the insertion of the head 18 of the screw 17 and a second portion 27 which is connected to the first portion 26 and has a smaller diameter which is substantially equal to the diameter of the central portion 19. The head 18 of the screw 17 is adapted to engage detachably in the second portion 27 so that its accidental escape is prevented.

The method of use of the assembly according to the invention is as follows. When the user of the case 3 needs to fix the shoulder strap 2, it is sufficient to insert each retention element 14 in the respective receptacle 12 and then insert each screw 17 in the respective through holes 16, engaging the threaded end portions 20 in the through female threads 15. The screws 17 are screwed into the female threads 15 until the respective abutment surfaces 23 abut against the retention elements 14, locked in the respective receptacles 12 (FIG. 3). Finally, the heads 18 of the screws 17 are inserted in the respective eyelets 21 of the ends 10, 11 of the shoulder strap 2, and specifically in the first portion 26, to be then locked in the second portion 27.

It has thus been shown that the invention achieves the intended aim and objects.

First of all, the assembly allows to ensure maximum reliability and solidity in the fixing of the shoulder strap 2 to the case 3; moreover, said fixing can be provided simply and quickly whenever necessary.

Secondly, the user (for example a technician or a professional with specific needs) can check at all times the solidity of the fixing, optionally replacing damaged or worn parts. In particular, it is possible to replace easily the retention element 14, for example if the female thread 15 is damaged by wear caused by repeated lockings and releases of the shoulder strap or by impacts or other accidental events.

The invention thus conceived is susceptible of numerous modifications and variations, all of which are within the scope of the appended claims.

All the details may further be replaced with other technically equivalent ones.

The embodiment of the present invention shall be carried out in the most scrupulous compliance with the statutory and regulatory provisions related to the products of the invention or correlated thereto and following any required authorization of the corresponding competent authorities, with particular reference to regulations related to safety, environmental pollution and health.

In practice, the materials used, as well as the shapes and the dimensions, may be any according to requirements without thereby abandoning the scope of the protection of the appended claims.

The disclosures in Italian Patent Application No. BO2005A000373 from which this application claims priority are incorporated herein by reference.

What is claimed is:

1. A container that has an outer surface and respective edges that are suitable to mate with each other in a closing configuration of the container, a shoulder strap having first and second fixing ends and an assembly for fixing the shoulder strap at said first and second ends thereof to the container, the assembly comprising: a first and a second receptacles fixed to the outer surface of the container, one for each one of said first and second shoulder strap ends, said receptacles being each shaped as a closed pocket provided with an opening facing in an opposite direction with respect to the edges of said container and, in a lateral wall, with a through hole that opens away from the surface of the container; at least one retention element for detachable retention of said ends of the shoulder strap, said retention element being plate shaped, provided with at least one female thread through hole in a side surface thereof, and suitable for insertion through said opening and for removable accommodation in either one of said receptacles so that the female thread through hole thereof faces, with corresponding arrangement, said through hole of the receptacle in which the retention element is inserted; at least one screw having an enlarged head, a central portion forming an abutment surface and a threaded free end portion, said threaded free end portion of the screw being adapted to pass through said through hole of the receptacle and engage detachably in said female thread through hole of the retention element with said abutment surface of the central portion bearing against said side surface of the retention element inserted in said receptacle; and at least one eyelet provided in any of said ends of the shoulder strap, said at least one screw being removably engageable with said enlarged head thereof in said at least one eyelet so as to allow rotation of said eyelet with respect to said at least one screw and prevent accidental detaching of the eyelet from said screw head.

2. A molded container composed of a first half shell and of second half shell articulated to each other and having an outer surface and respective edges that are suitable to mate with each other in a closing configuration of the container, a shoulder strap having first and second fixing ends and an assembly for fixing the shoulder strap at said first and second ends thereof to the container, the assembly comprising: a first and a second receptacles, one for each one of said first and second shoulder strap ends, that protrude from the outer surface of the container and are molded monolithically with one of said first and second half shells, said receptacles being each shaped as a closed pocket provided wit an opening facing in an opposite direction with respect to the edges of said container and, in a lateral wall, with a through hole that opens away from the surface of the container; at least one retention element for detachable retention of said ends of the shoulder strap, said retention element being plate shaped, provided with at least one female thread through hole in a side surface thereof, and suitable for insertion through said opening and for removable accommodation in either one of said receptacles so that the female thread through hole thereof faces, with corresponding arrangement, said through hole of the receptacle in which the retention element is inserted; at least one screw having an enlarged head, a central portion forming an abutment surface and a threaded free end portion, said threaded free end portion of the screw being adapted to pass through said through hole of the receptacle and engage detachably in said female thread through hole of the retention element with said abutment surface of the central portion bearing against said side surface of the retention element inserted in said receptacle; and at least one eyelet provided in any of said ends of the shoulder strap, said at least one screw being removably engageable with said enlarged head thereof in said at least one eyelet so as to allow rotation of said eyelet with respect to said at least one screw and prevent accidental detaching of the eyelet from said screw head.

3. An assembly for fixing a shoulder strap at first and second ends thereof to a container that has an outer surface and respective edges that are suitable to mate with each other in a closing configuration of the container, the assembly comprising: a first and a second receptacles fixed to the outer surface of the container, one for each one of the first and second shoulder strap ends, said receptacles being each shaped as a closed pocket provided with an opening facing in an opposite direction with respect to the edges of the container and, in a lateral wall, with a through hole that opens away from the surface of the container; at least one retention element for detachable retention of the ends of the shoulder strap, said retention element being plate shaped, provided with at least one female thread through hole in a side surface thereof, and suitable for insertion through said opening and for removable accommodation in either one of said receptacles so that the female thread through hole thereof faces, with corresponding arrangement, said through hole of the receptacle in which the retention element is inserted; at least one screw having an enlarged head, a central portion forming an abutment surface and a threaded free end portion, said threaded free end portion of the screw being adapted to pass trough said through hole of the receptacle and engage detachably in said female thread through hole of the retention element with said abutment surface of the central portion bearing against said side surface of the retention element inserted in said receptacle; and at least one eyelet provided in any of said ends of the shoulder strap, said at least one screw being removably engageable with said enlarged head thereof in said at least one eyelet so as to allow rotation of said eyelet with respect to said at least one screw and prevent accidental detaching of the eyelet from said screw head.

4. The assembly of claim 3, wherein said container comprises half shells, said receptacles shaped as a pocket being formed each by a protrusion which is provided substantially at an edge of one of said half-shells, said protrusion having a transverse cross-section which is substantially shaped like an inverted letter U, and being open on an opposite side with respect to said edge in order to allow insertion and extraction of the retention element.

5. The assembly of claim 4, wherein said protrusion is provided molded monolithically with one of the half-shells of the container.

6. The assembly of claim 4, comprising two retention elements, each of which is shaped substantially like a plate and has a transverse cross-section which is complementary to a cross-section of said receptacle, within which the retention elements are accommodated with suitable play in order to allow easy and quick insertion thereof and easy and quick extraction thereof.

7. The assembly of claim 4, wherein said central portion of said at least one screw has a larger diameter than said threaded free end portion and is adapted to be inserted without interference in said through hole of the receptacle.

8. The assembly of claim 7, wherein said at least one eyelet has a first opening portion for insertion of said head of the screw, a second opening portion connected to and smaller than said first opening portion and which has a diameter that is substantially equal to the diameter of said central portion of the screw, said screw head being suitable to engage said second opening portion so that accidental detaching thereof is prevented.

* * * * *